US008267002B1

(12) United States Patent
Benyami et al.

(10) Patent No.: US 8,267,002 B1
(45) Date of Patent: Sep. 18, 2012

(54) CERAMIC ARMOR AGAINST KINETIC THREATS

(75) Inventors: Moshe Benyami, Haifa (IL); Yehiel Reifen, Kiryat Hayim (IL); Ron Genussov, Haifa (IL)

(73) Assignee: Rafael Armament Development Authority Ltd., Haifa (IL)

( * ) Notice: Subject to any disclaimer, the term of this patent is extended or adjusted under 35 U.S.C. 154(b) by 850 days.

(21) Appl. No.: 11/495,890

(22) Filed: Jul. 31, 2006

(30) Foreign Application Priority Data

Aug. 1, 2005 (IL) ..... 170004

(51) Int. Cl.
*F41H 5/00* (2006.01)

(52) U.S. Cl. ..... 89/36.04; 89/36.07; 89/907

(58) Field of Classification Search ..... 89/36.04, 89/36.07, 36.11, 36.12; 109/49.5
See application file for complete search history.

(56) References Cited

U.S. PATENT DOCUMENTS

| | | | | | |
|---|---|---|---|---|---|
| 3,575,786 | A * | 4/1971 | Baker et al. | ..... | 428/215 |
| 4,323,000 | A | 4/1982 | Dennis et al. | | |
| 4,404,889 | A * | 9/1983 | Miguel | ..... | 89/36.02 |
| 4,664,967 | A | 5/1987 | Tasdemiroglu | | |
| 4,813,334 | A * | 3/1989 | Bloks et al. | ..... | 89/36.02 |
| 4,934,245 | A * | 6/1990 | Musante et al. | ..... | 89/36.02 |
| 5,200,256 | A * | 4/1993 | Dunbar | ..... | 428/212 |
| 5,767,435 | A * | 6/1998 | Reymann | ..... | 89/36.02 |
| 6,253,655 | B1 * | 7/2001 | Lyons et al. | ..... | 89/36.02 |
| 2003/0150321 | A1 * | 8/2003 | Lucuta et al. | ..... | 89/36.02 |

FOREIGN PATENT DOCUMENTS

| | | | |
|---|---|---|---|
| DE | 10 2004 060 268 | A1 | 6/2006 |
| EP | 0 299 503 | A2 | 1/1989 |
| EP | 334263 | A1 * | 9/1989 |
| EP | 0 933 612 | A2 | 8/1999 |
| IL | 139564 | | 8/2004 |

* cited by examiner

*Primary Examiner* — Bret Hayes

(74) *Attorney, Agent, or Firm* — Vorys, Sater, Seymour & Pease LLP; Susanne M. Hopkins; William L. Klima

(57) ABSTRACT

A ceramic armor tile for attaching internally behind a wall of a structure and for cooperation in conjunction therewith, such that the wall acts as an external protective layer of the armor.

34 Claims, 2 Drawing Sheets

CERAMIC ARMOR AGAINST KINETIC THREATS

FIELD OF THE INVENTION

The present invention relates to a ceramic armor for protecting enclosures such as vehicles and structures from kinetic threats.

BACKGROUND OF THE INVENTION

Ceramic armor tiles are widely used for protection of various objects and enclosures, such as combat vehicles (e.g. personnel carriers, etc.), aircrafts, marine crafts, and different constructions e.g. bunkers and the like, which hereinafter in the specification and claims are collectively referred to as structures. Such armor tiles are articulated to an exterior surface of the structure to be protected.

The above arrangement has some disadvantages, as follows:

- Low survivability of the armor tile owing to mechanical hits, e.g. by accidentally impacting by maneuvering vehicles, etc.:
- Increasing the silhouette of a vehicle fitted with such an armor, increasing its likelihood of being detected at a battle field;
- Increasing the external dimensions of a vehicle fitted with such an armor, thus reducing its maneuverability;
- Low survivability of the armor tile, i.e. low multiple hit capability;
- Often, a spall-liner is fitted inside a vehicle fitted with an external ceramic tile armor, so as to offer the crew and equipment of the vehicle ballistic protection against spall and debris (fragments of the projectile and the primary armor), which are shot into the cabin with high velocity, when the vehicle is hit. Even when the projectile does not penetrate the primary armor, spalls, which are knocked off the inner side of the primary armor, can be deadly for the personnel.
- A damaged exterior tile is replaceable only when threat is deceased;
- An externally mounted armor renders a passenger vehicle threatening and not eye pleasing, and further may suggest that passengers of the vehicle are high ranking officers or officials.

As a result of some of the above and other drawbacks of exterior ceramic armor tiles, there is sometimes a tendency to prefer metal protective armor which may be considered to be more durable as compared with ceramic tiles, in spite of weight deficiency of the metal armors.

Israel Patent No. 139564 is directed to a bullet-proof tile mountable on an inner surface of a body of a passenger vehicle to armor the body whereby occupants of the vehicle are shielded from bullets striking and penetrating the body. Each tile comprises a composite panel impervious to bullets having an inner face which faces the inner surface of the body, and a detachable fastener having complementary opposite components, one of said components being attached to the inner face of the tile, the other of said components being attached to the inner surface of the body, whereby when the tile is pressed against the body surface it then becomes securely fastened thereto.

It is an object of the present invention to provide an internal ceramic protection tile, i.e. fitted on an inside surface of an external wall of the enclosure/structure to be protected.

Herein after in the specification and claims, the terms 'armor panel', 'armor module' and 'armor tile' are use interchangeably.

SUMMARY OF THE INVENTION

According to the present invention there is provided a ceramic armor tile for attaching internally behind a wall of a structure and for cooperation in conjunction therewith, such that the wall acts as an external layer of the armor. It was found that such a configuration is useful in minimizing the hazards of kinetic threats and shows improved performances as compared with an externally mounted ceramic armor of similar parameters.

An armor according to the disclosure of the present invention is in particular suited against kinetic threats, whilst in case of hollow-charges it is likely to minimizing damage by reducing spall dispersion (reducing the cone angle of fragments and shrapnel). The thicker the external wall of the enclosure/structure, the better is protection offered by the armor.

According to one embodiment of the present invention, the ceramic armor tile comprises at least a layer of ceramic material and a backing layer. Optionally, there is provided also a spall-liner, at least at a back face thereof, for reducing the cone angle of fragments dispersed form the ceramic layer in case of the ceramic layer is hit; the spall-liner may be made of ballistic fabric e.g. Kevlar™, Dyneema™, Spectra™, ballistic nylon, and non fabric materials such as steel, aluminum, etc.

According to one modification of the invention, the backing of the ceramic panel constitutes a spall-liner of the structure, thus reducing overall thickness and weight of the armor.

According to one particular embodiment, the ceramic tile is spaced from the inner surface of the wall of the construction by fasteners and spacers (optionally honeycomb-like structures or foamed material), and according to a different embodiment of the invention the ceramic tile adjoins the inner surface of the wall of the construction. However, in the later case it is preferred to introduce a confinement layer intermediate the inside surface of the wall and the ceramic tile. Such a confinement layer is typically made of a resilient material.

The ceramic armor may be fixedly attached to the inner wall or detachable therefrom. Attachment may be fixtures such as bolts or by adhering or by hook and pile fasteners (Velcro™), etc.

BRIEF DESCRIPTION OF THE DRAWINGS

In order to understand the invention and to see how it may be carried out in practice, some embodiments will now be described, by way of non-limiting examples only, with reference to the accompanying drawings, in which.

DETAILED DESCRIPTION OF EXEMPLARY EMBODIMENTS

Figure 1:
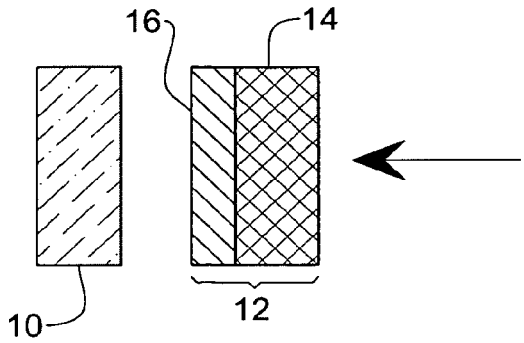
Prior Art FIG. 1
FIG. 1 is a schematic representation illustrating a section through a side wall of an armored vehicle, fitted with a prior art exterior ceramic tile.

Attention is first directed to FIG. 1 of the drawings schematically illustrating a section through an armored vehicle, e.g. a troop carrier where the wall generally designated 10 is for example an 8 mm steel plate fitted at its exterior with a ceramic armor module generally designated 12 and comprising a ceramic tile 14, e.g. made of alumina with a backing 16 made for example of Kevlar™ Dyneema™, Spectra™, ballistic nylon, and non fabric materials such as steel, aluminum, fiberglass, etc. Typically, there is a distance between the pane 10 and the armor module 12 of about 20 mm.

Figure 2:
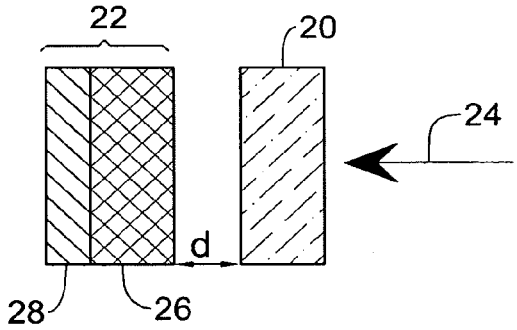
FIG. 2 is a schematic representation illustrating a section through a side wall of an armored vehicle, fitted with an interior ceramic tile according to an embodiment of the present invention.

FIG. 2 illustrates a first embodiment in accordance with the present invention where the wall 20 of the vehicle is external to the armor panel (module/tile) 22 namely facing the kinetic threat 24. In this embodiment, armor module 22 comprises a ceramic layer 26 and a backing layer 28, similar to the embodiment disclosed in connection with FIG. 1. It is further noticed that the ceramic panel 22 is spaced apart at distance d which distance is approximately in the range of 20 mm.

It was found that the arrangement disclosed in FIG. 2 has improved features as compared with the parallel embodiment of FIG. 1 whereby the wall 20 of the vehicle constitutes in fact a component of the armor and cooperates in conjunction with the armor module 22 whereby the kinetic threat 24 first engages the external wall 20 and loses some of its kinetic energy such that when it encounters the ceramic panel 22 it is not likely to penetrate it.

Figure 3:
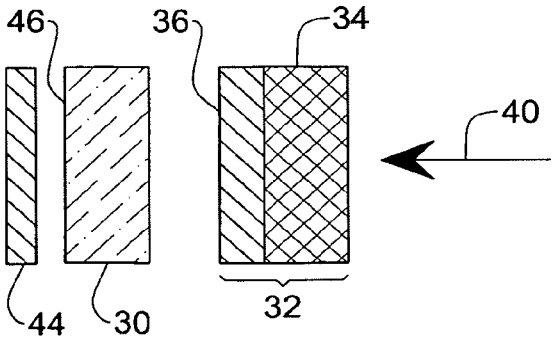
Prior Art FIG. 3
FIG. 3 is a schematic representation illustrating a section through a side wall of an armored vehicle, fitted with a modification of a prior art exterior ceramic tile.

The embodiment of FIG. 3 discloses a variation of the embodiments of FIG. 1 wherein the external wall of the vehicle 30 is fitted on its outside with a ceramic armor 32 comprising a ceramic tile 34 fitted with a backing 36, which armor faces the kinetic threat 40. In addition, the vehicle is fitted on an inside thereof with a spall liner 44 adjoining the inner surface 46 of wall 30 which spall liner is useful in minimizing the hazards of fragments disbursed from the wall 30 (i.e. decreasing the debris cone angle).

Figure 4:
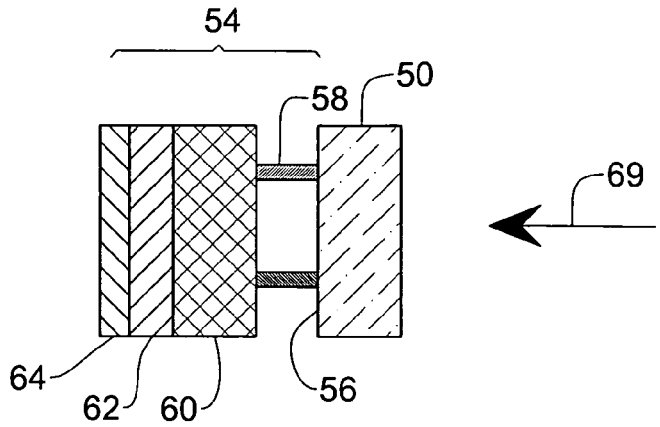
FIG. 4 is a schematic representation illustrating a section through a side wall of an armored vehicle, fitted with an interior ceramic tile according to another embodiment of the present invention.

With further reference now to FIG. 4 there is illustrated still a modification of the invention wherein an external wall 50 of the protected enclosure, e.g. a structure, a vehicle, etc., is fitted on its interior with a armor module 54 fixedly secured to an inner face 56 of wall 50 by a plurality of bolt spacers 58. The protective module comprises a ceramic layer 60, a backing 62 and optionally, an additional layer of spall liner 64 (these however may be integrated into one layer). It is however noticed that the kinetic threat 69 first encounters the wall 50 which cooperates in conjunction with the armor module 54 and reduces the kinetic energy of the kinetic threat prior to its engagement with the protective armor 54.

Figure 5:
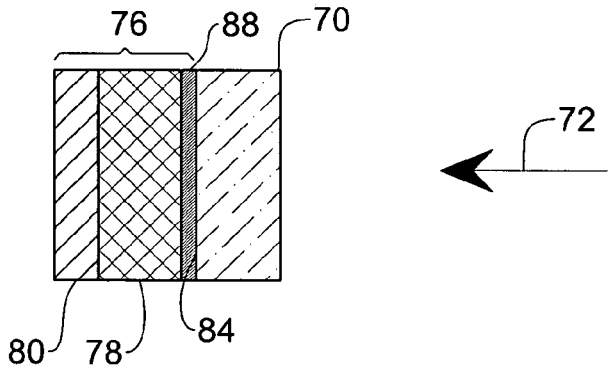
FIG. 5 is a schematic representation illustrating a section through a side wall of an armored vehicle, fitted with an interior ceramic tile according to another embodiment of the present invention.

In the embodiment of FIG. 5 there is illustrated a different embodiment of the present invention wherein the external wall 70 of the protected enclosure (the direction of a potential oncoming kinetic threat is illustrated by arrow 72), said wall 70 is fitted at its interior with a ceramic armor in accordance with the present invention generally designated 76 comprising a ceramic layer 78 and a backing 80. However in the present embodiment, the armor module 76 adjoins the inside surface 84 of wall 70 however with an intermediate confinement layer 88 extending between the ceramic layer 78 and wall 70.

The confinement layer is typically made of a resilient layer several millimeters thick which is adapted to absorb deformation of the external wall 70 upon hitting by the kinetic threat 72.

Figure 6:
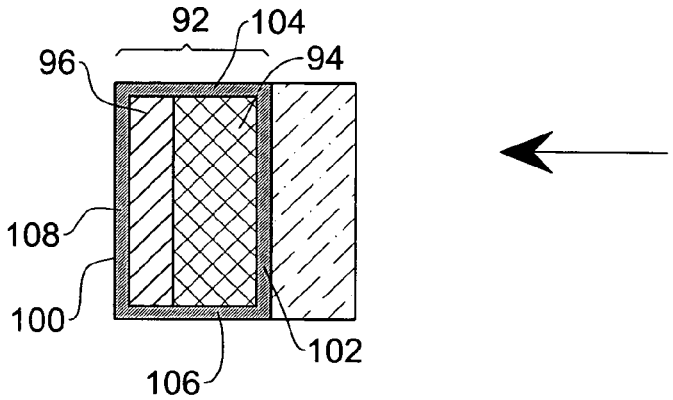
FIG. 6 is a schematic representation illustrating a section through a side wall of an armored vehicle, fitted with an interior ceramic tile according to a different embodiment of the present invention.

In the embodiment of FIG. 6 there is illustrated a modification of the embodiment seen in FIG. 5 wherein the protective armor 92 comprises a ceramic layer 94, a backing 96 and is entirely enveloped by an enveloping layer 100 of which wall 102 serves as a confinement layer whilst walls 104, 106 and 108 serve as spall liners, as discussed hereinabove.

Whilst some embodiments have been described and illustrated with reference to some drawings, the artisan will appreciate that many variations are possible which do not depart from the general scope of the invention, mutatis mutandis.

The invention claimed is:

1. An armor system against an incoming projectile, comprising:

an external wall; and an armor module attached to an inner surface of the external wall, the armor module comprising:

at least one armor tile comprising at least one ceramic layer of ceramic material; and a backing attached to the ceramic layer serving as a spall-liner, the armor module being attached to the inner surface of the external wall such that the external wall is configured to act as an external ballistic protection layer of the armor module, the external wall having such a ballistic property so as to reduce the kinetic energy of the projectile, externally approaching the external wall, to such an extent as to be arrested by said layer of ceramic material and said backing.

2. The armor system according to claim 1, wherein the at least one tile is directly connected and spaced from the inner surface of the wall by multiple fasteners or a spacer.

3. The armor system according to claim 1, wherein the at least one tile adjoins the inner surface of the external wall.

4. The armor system according to claim 3, wherein a confinement layer is provided intermediate between the inner surface of the external wall and the at least one tile.

5. The armor system according to claim 4, wherein the confinement layer is integrated with the at least one tile.

6. The armor system according to claim 4, wherein the confinement layer is made of a resilient material.

7. The armor system according to claim 1, wherein the at least one tile is fixedly attached to the inner surface of the external wall.

8. The armor system according to claim 1, wherein the at least one tile is detachably fixed to the inner surface of the external wall.

9. The armor system according to claim 8, wherein the at least one tile is fixed to the inner surface of the external wall by bolt fixtures.

10. The armor system according to claim 8, wherein the at least one tile is adhered to the inner surface of the external wall.

11. The armor system according to claim 8, wherein the at least one tile is fixed to the inner surface of the external wall by hook and pile fasteners.

12. The armor system according to claim 1, wherein the external wall is made of metal.

13. An armor module according to claim 1, wherein said ceramic layer and said backing are sufficient for arresting said projectile after penetrating said external wall.

14. An armor module according to claim 1, wherein said backing is directly attached to the ceramic layer.

15. A method for protecting an enclosure against kinetic threats, the method comprising:

attaching an armor module to an inner surface of an external wall providing ballistic protection, the armor module comprising a ceramic armor tile comprising at least one layer of ceramic material and a backing attached to the ceramic layer serving as a spall-liner, wherein the armor module is attached to the inner surface of the external wall such that the armor module is configured to act as an external ballistic protection layer of the armor module, the external wall having such ballistic property so as to reduce the kinetic energy of the projectile, externally approaching the external wall, to such an extent as to be arrested by said layer of ceramic material and said backing.

16. The method according to claim 15, wherein the at least one tile is spaced from the inner surface of the wall by fasteners and spacers.

17. The method according to claim 15, wherein the at least one tile adjoins the inner surface of the external wall.

18. The method according to claim 15, further comprising providing a confinement layer intermediate between the inner surface of the external wall and the at least one tile.

19. The method according to claim 18, wherein the confinement layer is integrated with the at least one tile.

20. The method according to claim 18, wherein the confinement layer is made of a resilient material.

21. The method according to claim 20, wherein the at least one tile is fixed to the inner surface of the external wall by bolt fixtures.

22. The method according to claim 20, wherein the at least one tile is adhered to the inner surface of the external wall.

23. The method according to claim 20, wherein the at least one tile is fixed to the inner surface of the external wall by hook and pile fasteners.

24. The method according to claim 15, wherein the at least one tile is fixedly attached to the inner surface of the external wall.

25. The method according to claim 15, wherein the at least one tile is detachably fixed to the inner surface of the external wall.

26. The method according to claim 15, wherein the external wall is made of metal.

27. A method according to claim 15, wherein ballistic properties of said ceramic layer and said backing are chosen so at to arrest the projectile after penetrating the external wall.

28. A structure, comprising:

an external wall; and an armor module attached to an inner surface of the external wall, the armor module comprising a ceramic armor tile comprising at least one layer of ceramic material and a backing attached to the ceramic layer serving as a spall-liner, wherein the armor module being attached to the inner surface of the external wall such that the armor module is configured to act as an external ballistic protection layer of the armor module, the external wall having such ballistic property so as to reduce the kinetic energy of the projectile, externally approaching the external wall, to such an extent as to be arrested by said layer of ceramic material and said backing.

29. The structure according to claim 28, wherein the structure is an armored vehicle.

30. The structure according to claim 28, wherein the external protective structure wall is made of metal.

31. An armor system against an incoming projectile, comprising:

an external wall; and an armor module having spaced apart points of connection with the external wall or a surface area connection with an inner surface area of the external wall, the armor module comprising at least one armor tile comprising at least one ceramic layer of ceramic material and a backing attached to the ceramic layer serving as a spall-liner, wherein the spaced apart points of connection or surface area connection between the armor module and external wall allows the armor module and external wall to cooperate together as an armor unit, and wherein the external wall is configured to act as an external ballistic protection layer of the armor module, the external wall having such ballistic property so as to reduce the kinetic energy of the projectile, externally approaching the external wall, to such an extent as to be arrested by said layer of ceramic material and said backing.

32. An armor system against an incoming projectile, the system comprising:

an external wall comprising armor plate; and an armor module comprising:

an armor tile positioned internally behind the external wall and for cooperation in conjunction with the external wall such that the external wall acts as an external layer of the of the armor system, the armor tile comprising at least one ceramic layer; and a backing attached to and located directly behind the ceramic layer serving as a spall-liner, wherein the external wall is configured to act as an external ballistic protection layer of the armor module, the external wall having such a ballistic property so as to reduce the kinetic energy of the projectile, externally approaching the external wall, to such an extent as to be arrested by the armor tile and backing.

33. A system according to claim 32, wherein the armor plate is an 8 mm steel plate.

34. A system according to claim 33, wherein the external wall and armor module are a layered structure.

* * * * *

UNITED STATES PATENT AND TRADEMARK OFFICE

CERTIFICATE OF CORRECTION

PATENT NO. : 8,267,002 B1
APPLICATION NO. : 11/495890
DATED : September 18, 2012
INVENTOR(S) : Moshe Benyami et al.

It is certified that error appears in the above-identified patent and that said Letters Patent is hereby corrected as shown below:

Title page, item (73) Assignee: should read as follows:

~~RAFAEL ARMAMENT DEVELOPMENT AUTHORITY LTD., HAIFA (IL)~~

RAFAEL ADVANCED DEFENSE SYSTEMS LTD., HAIFA (IL)

Signed and Sealed this
Twenty-third Day of October, 2012

David J. Kappos

David J. Kappos
*Director of the United States Patent and Trademark Office*